US012715553B2

(12) United States Patent
Dawley et al.

(10) Patent No.: US 12,715,553 B2
(45) Date of Patent: Aug. 25, 2026

(54) HYDROFOIL ATTACHMENT SYSTEM FOR BOARDSPORT EQUIPMENT AND RELATED SYSTEMS AND METHODS

(71) Applicant: Liquid Force, Carlsbad, CA (US)

(72) Inventors: Patrick Bryan Dawley, Loudon, TN (US); Walid Motawi, Carlsbad, CA (US); Peter Mehrof, Hood River, OR (US)

(73) Assignee: Liquid Force, Carlsbad, CA (US)

( * ) Notice: Subject to any disclaimer, the term of this patent is extended or adjusted under 35 U.S.C. 154(b) by 231 days.

(21) Appl. No.: 18/769,259

(22) Filed: Jul. 10, 2024

(65) Prior Publication Data

US 2025/0019050 A1 Jan. 16, 2025

Related U.S. Application Data

(60) Provisional application No. 63/512,900, filed on Jul. 10, 2023.

(51) Int. Cl.
*B63B 32/66* (2020.01)

(52) U.S. Cl.
CPC ..... *B63B 32/66* (2020.02)

(58) Field of Classification Search
CPC ..... B63B 32/66; B63B 1/242; B63B 32/60; B63B 32/50; A63C 10/14
See application file for complete search history.

(56) References Cited

U.S. PATENT DOCUMENTS

| | | | | |
|---|---|---|---|---|
| 6,523,851 | B1 * | 2/2003 | Maravetz | A63C 5/02 280/14.22 |
| 9,359,044 | B2 | 6/2016 | Langelaan | |
| 9,586,659 | B2 | 3/2017 | Langelaan | |
| 11,148,763 | B2 * | 10/2021 | Moltrup | B63B 32/66 |
| 11,608,146 | B2 * | 3/2023 | Lyon | B63B 32/66 |
| 12,187,390 | B2 * | 1/2025 | Reh Aguirre De Carcer | B63B 32/51 |
| 2021/0047008 | A1 * | 2/2021 | Reh Aguirre De Carcer | B63B 32/77 |
| 2021/0114691 | A1 * | 4/2021 | Harmon | B63B 32/66 |
| 2021/0347441 | A1 * | 11/2021 | Lyon | B63B 32/66 |
| 2022/0258838 | A1 * | 8/2022 | Reh Aguirre De Carcer | B63B 32/51 |
| 2024/0375754 | A1 * | 11/2024 | Wieczorek | B63B 32/66 |

FOREIGN PATENT DOCUMENTS

| | | | | |
|---|---|---|---|---|
| ES | 2740976 | B2 * | 3/2021 | B63B 32/66 |

* cited by examiner

*Primary Examiner* — Eldon T Brockman
(74) *Attorney, Agent, or Firm* — BakerHostetler

(57) ABSTRACT

The present technology is generally directed to an attachment system for boardsport equipment, a boardsport system including thereof, and a method of using thereof. In various embodiments, the attachment system includes a plurality of attachment rails fixedly attached to an external surface of a watersport board such that the attachment rails project outwardly away from the external surface, an attachment assembly configured to releasably couple to the plurality of attachment rails, and a plurality of locking components each of which is on the attachment plate and configured to slidably couple the attachment plate to one of the plurality of the attachment rails.

20 Claims, 13 Drawing Sheets

HYDROFOIL ATTACHMENT SYSTEM FOR BOARDSPORT EQUIPMENT AND RELATED SYSTEMS AND METHODS

CROSS-REFERENCE TO RELATED APPLICATION

The present application claims the benefit of U.S. Provisional Application No. 63/512,900, filed Jul. 10, 2023, which is incorporated herein by reference in its entirety.

TECHNICAL FIELD

The present technology is directed generally to boardsport equipment and, more particularly, to hydrofoil attachment systems for boardsport equipment and related systems and methods.

BACKGROUND

Boardsports are activities that use a board as the primary equipment. Many of these boardsports take place in the water, such as surfing, kite boarding, paddle boarding, windsurfing, wakeboarding, bodyboarding. Some of the boards used in such water sports have components extending from the board to facilitate or enhance the performance. For example, a foil board has a hydrofoil connected to the underside of the board and positioned near the aft of the board. The hydrofoil projects away from the underside of the foil board and, when in use, deflects the flow of water downward to lift the board and a rider thereon out of the water when traveling at sufficient speed.

BRIEF DESCRIPTION OF THE DRAWINGS

Many aspects of the present disclosure can be better understood with reference to the following drawings. The components in the drawings are not necessarily to scale. Instead, emphasis is placed on clearly illustrating the principles of the present disclosure.

Like reference numerals have been used in the figures to identify like components.

DETAILED DESCRIPTION

Figure 1A:
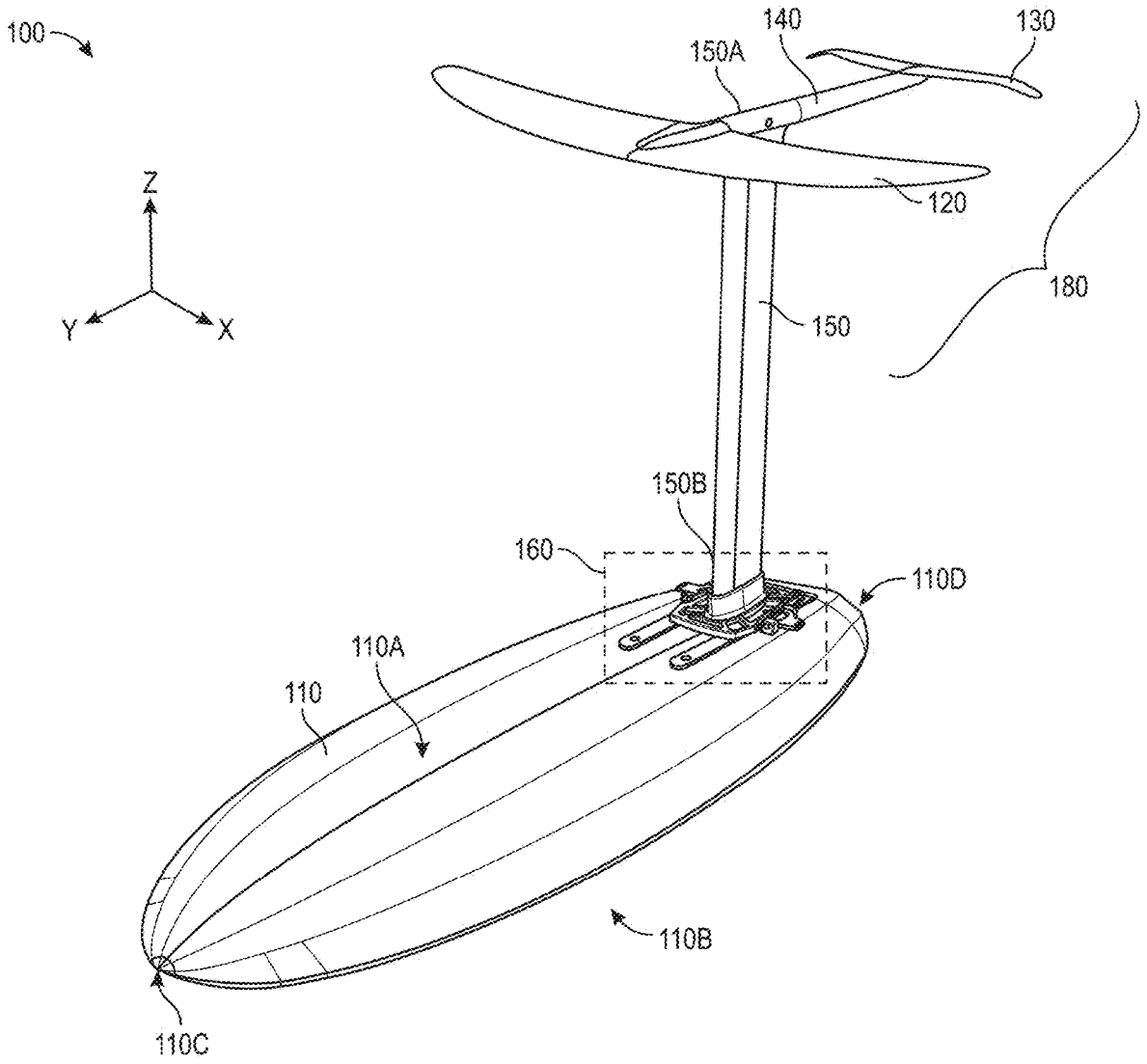
FIGS. 1A and 1B are perspective and side views of a hydrofoil mounted to a watersport board configured in accordance with embodiments of the present technology.

Hydrofoil attachment assemblies for boardsport equipment, as well as associated systems and methods, are disclosed herein. The hydrofoil attachment assemblies can be used in conjunction with various types of boards for water sports, such as foil surfboards, motored/electric foil boards, wakeboards, surfboards, kite boards, water skis, and/or other types of boardsport equipment. Foil boards, for example, have a hydrofoil projecting away from the underside of the board to deflect the flow of water in a manner that lifts the board out of the water. The present technology includes foil attachment assemblies that allow for the removeable and/or adjustable attachment of a hydrofoil and/or other structure to a watersport board to facilitate or enhance the performance, storage, and/or transport of the board or of the additional structure or component. In some embodiments, the attachment assembly can include one or more adjustable locking components (also referred to as locking mechanisms) coupled to a mast (also referred to as a strut) of a hydrofoil at the end opposite the foil structure, and these locking components can slide onto one or more external rails positioned on the underside of a watersport board and secure the hydrofoil to the board in a desired location along the rails. Unlike other hydrofoil attachment systems that have internal tracks positioned within cavities formed in the underside of the board and connection structures (e.g., pin and lock mechanisms) secured to the internal tracks, the present technology has an entirely external attachment mechanism. This simplifies the structure and manufacture of the board and, without the need for internal tracks, can also reduce the overall thickness and weight of the board. The locking components can include cam clamps and/or other attachment structures that can move between a locked state and a released state by a user without the need for any additional tools. This toolless attachment mechanism allows the user to conveniently remove the hydrofoil from the board during transport and storage, as well as adjust the position of the hydrofoil along the length of the attachment rails, even when the board with the hydrofoil is in use in the water. The position of the hydrofoil along the length of the board can substantially affect a user's riding experience, and thus the ease of toolless adjustment provided by the attachment assemblies disclosed herein, as well as the ability to make these small or large adjustments during use (e.g., when the board is in the water) provides an enhanced riding experience. For example, hydrofoils positioned closer to the back end of a board may give less lift than when positioned more forward closer to the center of the board. Accordingly, a user may wish to adjust the position of the hydrofoil relative to the length of the board depending on one or more factors including, e.g., the user's experience level, the user's preference or expectation for a particular ride, the weather conditions, and/or the conditions of the water. In addition, the attachment assemblies disclosed herein facilitate quick removal of the hydrofoil from the board to allow the board to be transported and stored separate from the hydrofoil. Without the hydrofoil attached, the board no longer has an awkward, bulky shape, and thus the disassembled system has a smaller overall footprint and the board has a more regular shape that eases transportation (e.g., in a car) and storage (e.g., stacked in a manner that would not be feasible with the hydrofoil attached.

Specific details of several embodiments of the present technology are described herein with reference to FIGS. 1A-5. The present technology, however, can be practiced without some of these specific details. For example, various embodiments are described below with respect to an attachment assembly for a foil mast on a foil board. However, the disclosed technology can be used to attach foils, masts, and/or other structures to different types of boards or watersport structures. In some instances, well-known structures and techniques often associated with watersport boards, and the like, have not been shown in detail so as not to obscure the present technology. The terminology used in the description presented below is intended to be interpreted in its broadest reasonable manner, even though it is being used in conjunction with a detailed description of certain specific embodiments of the disclosure. Certain terms can even be emphasized below; however, any terminology intended to be interpreted in any restricted manner will be overtly and specifically defined as such in this Detailed Description section.

The accompanying Figures depict embodiments of the present technology and are not intended to be limiting of its scope. The sizes of various depicted elements are not necessarily drawn to scale, and these various elements can be arbitrarily enlarged to improve legibility. Component details can be abstracted in the Figures to exclude details such as position of components and certain precise connections between such components when such details are unnecessary for a complete understanding of how to make and use the present technology. Many of the details, dimensions, angles, and other features shown in the Figures are merely illustrative of particular embodiments of the disclosure. Accordingly, other embodiments can have other details, dimensions, angles, and features without departing from the spirit or scope of the present technology.

For illustrative purposes, a coordinate system is provided in FIGS. 1A-4F, in which an x-axis extends along a transverse axis or width direction of a watersport board (between opposing sides of the board 110), an y-axis is orthogonal to the x-axis and extends along a longitudinal axis or length direction of the watersport board (e.g., from the tail portion 110D to the nose portion 110C of the board 110 as illustrated in FIG. 1A), and a z-axis extends orthogonal to the x- and y-axis through the thickness of the watersport board (e.g., from the top surface 110B to the bottom surface 110A of the board 110 as illustrated in FIG. 1A).

Figure 1B:
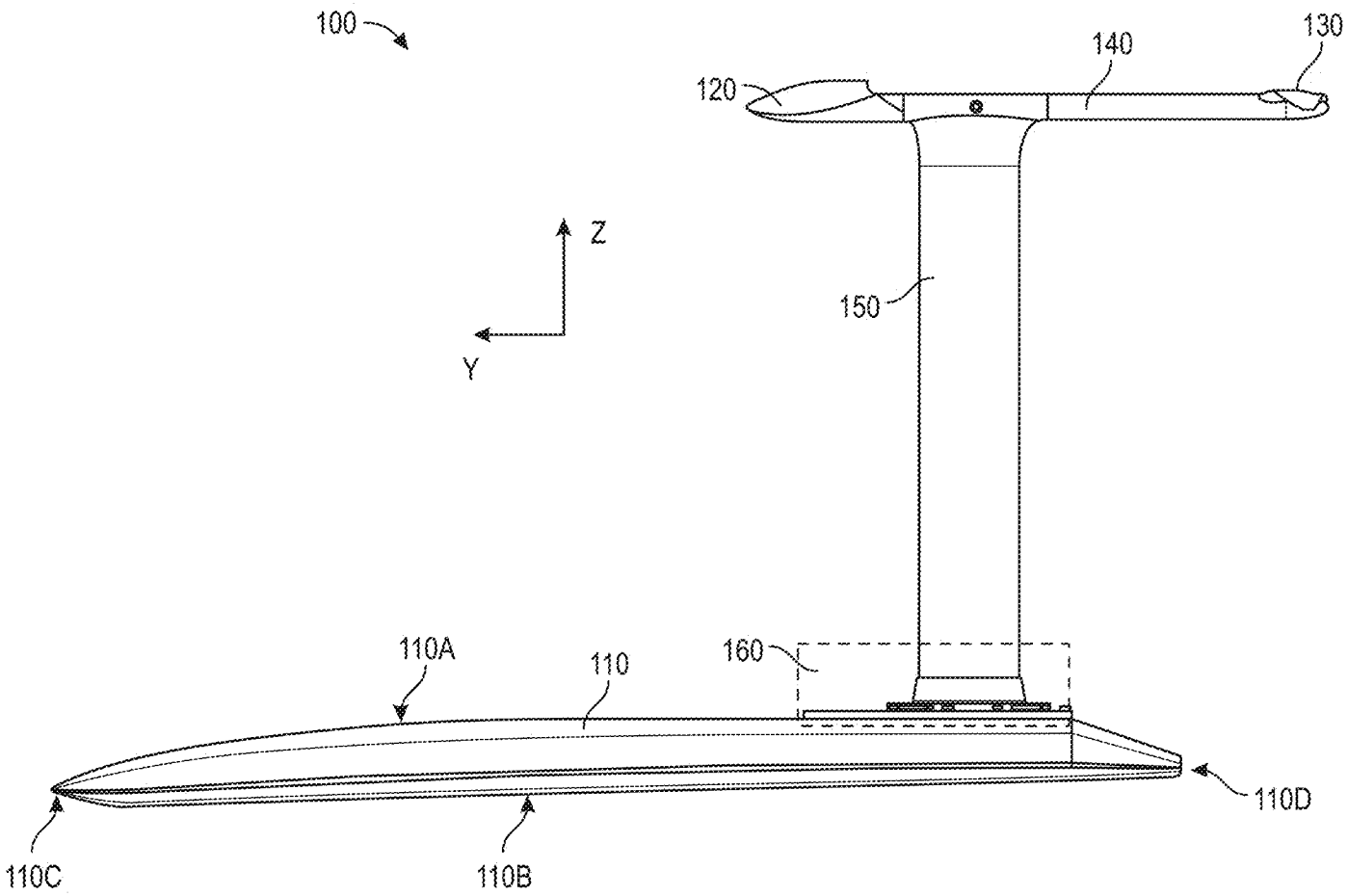

FIGS. 1A and 1B are perspective and side views of a watersport system 100 including a hydrofoil 180 mounted to a watersport board 110 ("board 110") in accordance with embodiments of the present technology. The board 110 has a bottom surface 110A, a top surface 110B opposite the bottom surface 110A, a nose portion 110C at the front of the board 110, and a tail portion 110D at the trailing end of the board 110 opposite the nose portion 110C. The hydrofoil 180 may include a front wing 120, a tail wing 130, a fuselage 140 connecting the front wing 120 and the tail wing 130, and a mast 150 (also referred to as a "strut") extending away from an underside of the board 110. The front wing 120 leads and produces lift when the hydrofoil 180 is travelling forward through water. When the hydrofoil 180 moves sufficiently fast, the front wing 120 may generate sufficient lift to elevate the board 110 carrying the user above the water. The tail wing 130 can assist in stabilizing the hydrofoil 180. The mast 150 extends away from the board 110 along the z-axis (FIG. 1A) and has a first end portion 150A joined to the fuselage 140 (e.g., at or near a right angle), and a second end portion 150B connected to the bottom surface 110A of the board 110 via an attachment system 160. The hydrofoil 180 can be positioned closer to the tail portion 110D of the board 110 than the nose portion 110C and, via the attachment system 160, the position of the hydrofoil 180 along the length of the board 110 can be manually adjusted during use.

Figure 2A:
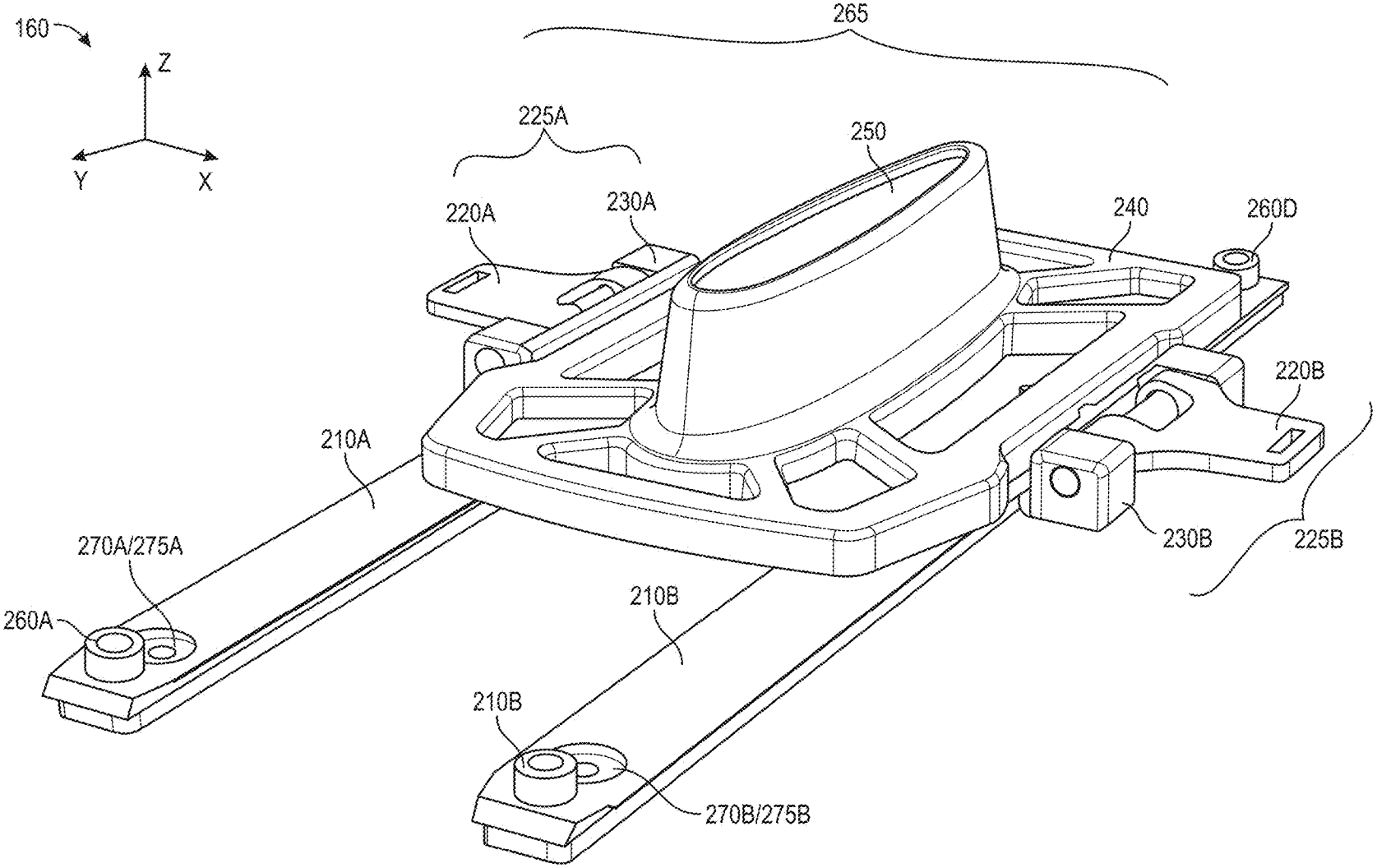
FIG. 2A is a perspective view of a hydrofoil attachment assembly configured in accordance with embodiments of the present technology.
Figure 2B:
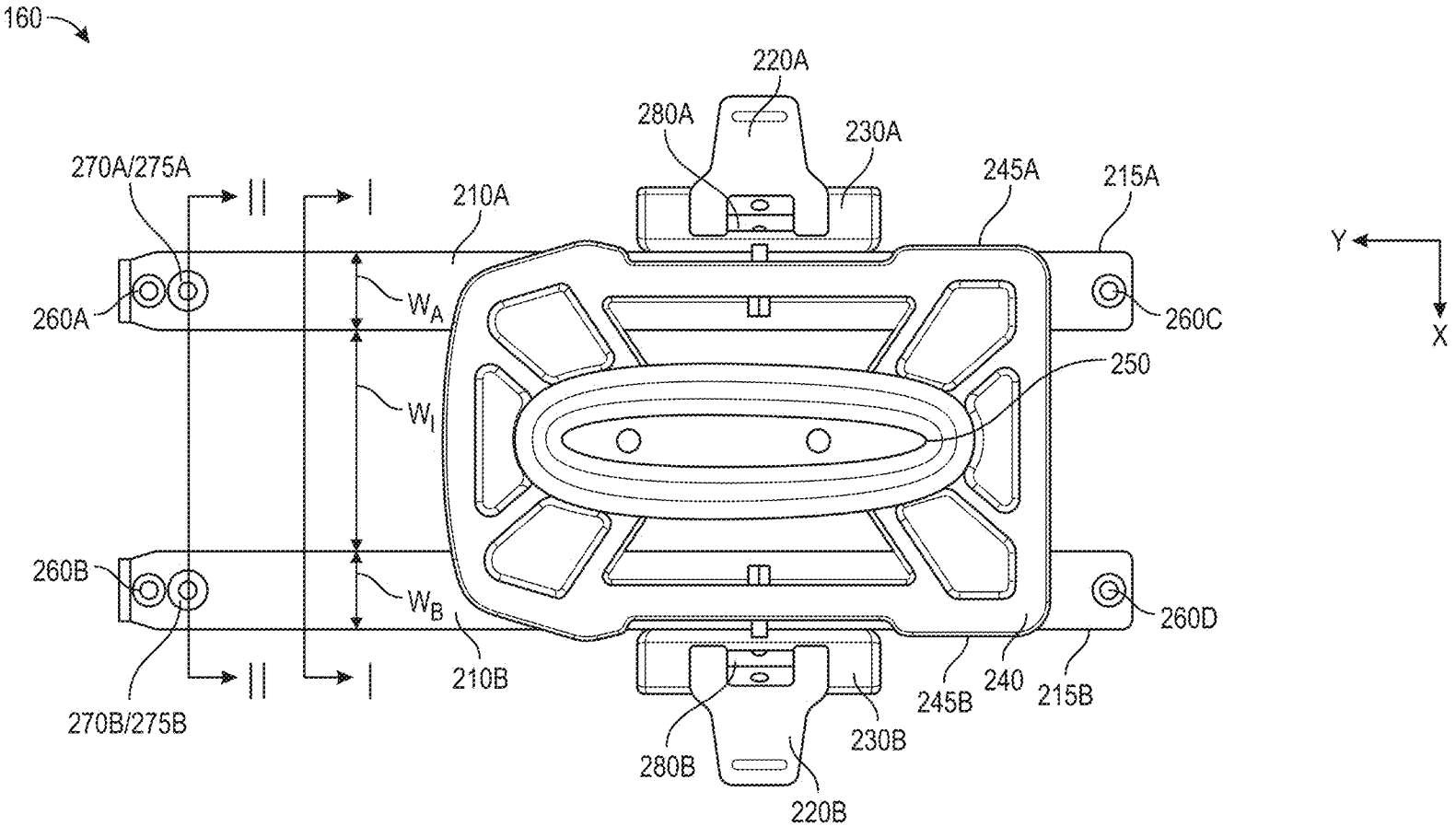
FIGS. 2B and 2C are top views of the hydrofoil attachment assembly of FIG. 2A with an attachment plate shown at different positions.
Figure 2C:
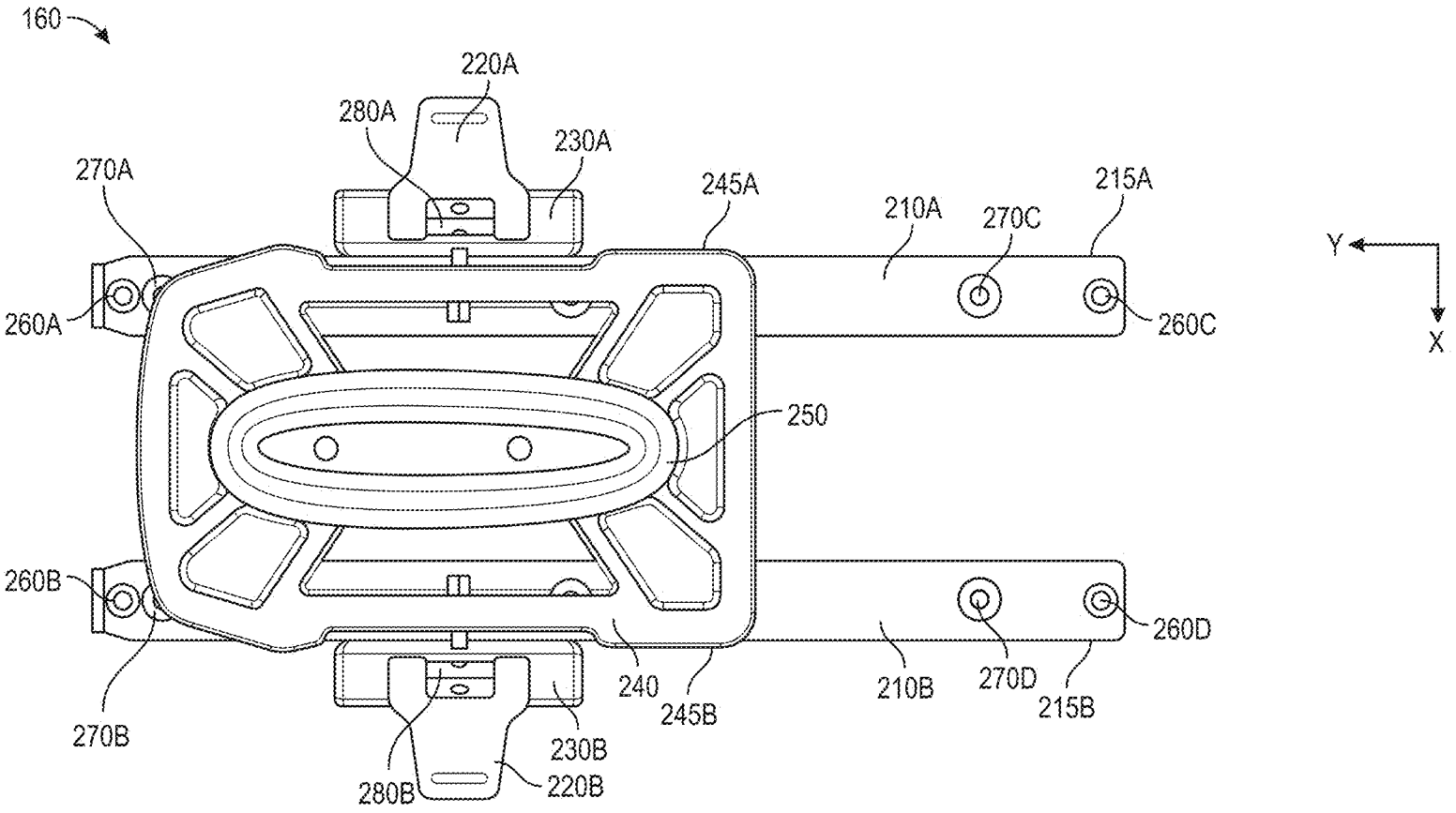

FIG. 2A is a perspective view of the hydrofoil attachment system 160 of FIGS. 1A and 1B configured in accordance with embodiments of the present technology. FIGS. 2B and 2C are top views of the hydrofoil attachment system 160 of FIG. 2A in different longitudinal positions.

The attachment system 160 can include one or more attachment rails 210 (identified individually as a first attachment rail 210A and a second attachment rail 210B), and an attachment assembly 265 that removably connects a hydrofoil or other structure (e.g., a fin) to the attachment rails 210 to removably secure the hydrofoil or other structure to a watersport board (e.g., the board 110 of FIGS. 1A and 1B). The attachment assembly 265 can include an attachment plate 240 having a mast attachment base 250 (also referred to as a mast connector), and one or more locking components 225 (identified individually as a first locking component 225A and a second locking component 225B) that releasably connect the attachment plate 240 to the attachment rails 210.

The attachment rails 210 may be fixedly mounted on an external surface of a watersport board (e.g., the bottom surface 110A of the board 110 (FIG. 1A)). For example, in the embodiment illustrated in FIGS. 2B and 2C, the first attachment rail 210A includes two attachment rail mounting holes 270 (identified individually as 270A and 270C) located at or near the opposing end portions of the first attachment rail 210A, respectively, that can receive fasteners 275 (identified individually as 275A and 275C) to secure the first attachment rail 210A to the exterior bottom surface of the watersport board. Similarly, the attachment rail 210B includes two attachment rail mounting holes 270 (identified individually as 270B and 270D) located at or near the opposing end portions of the attachment rail 210B, respectively, that can receive fasteners 275 (identified individually as 275B and 275D) to secure the second attachment rail 210B to the exterior bottom surface of the watersport board. Examples of the attachment rail mounting fasteners 275 include screws, nails, bolts, anchors, rivets, and/or other types of fasteners. The attachment rails 210 may be positioned on the external, bottom surface of the watersport board, and the attachment rail mounting fasteners 275 may extend through the corresponding attachment rail mounting holes 270 and at least partially penetrate the board through the bottom surface to secure the rails 210 thereto. In some embodiments, one or both of the attachment rails 210 can include one or more attachment holes that receive corresponding fasteners, and/or the attachment rails 210 can be fixedly attached to the board using other suitable fastening mechanisms, such as adhesives (e.g., glue), welding, interference fit, and the like. The attachment rails 210 may be mounted onto the bottom surface 110A using a same mounting mechanism, or different mounting mechanisms. In some embodiments, the attachment rails 210 can be fixedly and non-permanently mounted to the board using screws, nuts, or the like, such that the attachment rails may be replaced, removed, and/or remounted to the bottom surface at a same or different location.

The attachment rails 210 can be positioned on the external surface of the board 110 and project outwardly away from the bottom surface of the watersport board. This is unlike internal tracks that are positioned within slits made in the external surface of watersport boards (i.e., internal tracks located between the external top and bottom surfaces of the watersport boards and accessible from the bottom surface). This avoids the need to cut into the board 110 for mounting the attachment rails 210 to the board, and also removes the need of the board to have a thickness that can accommodate internal rails/tracks. As such, the external attachment rails 210 ease manufacture and assembly of the board, and do not impose a required thickness on the board itself. See, e.g., FIGS. 3A and 3B, and relevant description thereof.

In some embodiments, each of one or more of the attachment rails 210 may include one or more stoppers 260 (identified individually as stoppers 260A through 260D) spaced apart from each other by a distance along the attachment rail 210. The stopper 260 may provide a physical barrier that limits the motion of the attachment plate 240 along the attachment rail 210. For example, the stoppers 260A and 260C may be spaced apart from each other by a distance that defines a movement range within which the attachment plate 240 is allowed to slide along the attachment rail 210A, while the stoppers 260B and 260D may be spaced apart from each other by a distance that defines a movement range within which the attachment plate 240 is allowed to slide along the attachment rail 210B. FIGS. 2A and 2B show the attachment plate 240 at a first position in which movement further along the y-axis toward the tail portion of the board (e.g., the tail portion 110D of the board 110 as illustrated in FIG. 1A) is limited by the stoppers 260C and 260D. FIG. 2C shows the attachment plate 240 at a second position in which movement further along the y-axis toward the nose portion of the board (e.g., the nose portion 110C of the board 110) is limited by the stoppers 260A and 260B.

The first and second attachment rails 210A and 210B may be spaced apart from each other by an inter-rail spacing $W_I$ across the width of the board (e.g., along the x-axis) and can be parallel to each other. Each attachment rail 210 has rail dimensions including a rail width ($W_A$ and $W_B$, respectively) along the x-axis, a rail length along the y-axis, and a rail thickness along the z-axis. One or more of the inter-rail spacing $W_I$ and the rail dimensions (including the rail widths $W_A$ and $W_B$, the rail lengths, and the rail thicknesses) may be selected based on one or more factors including, e.g., the dimensions (e.g., width, length) of the board, the positioning of one or more components (e.g., the attachment rail mounting holes 270), the attachment rail mounting fasteners 275, the stoppers 260, the mounting mechanism(s), the locking mechanism 225 that connects the attachment plate 240 to the attachment rails 210, the material property/properties of the board and/or the attachment rails 210, the dimension or mechanical property/properties of the attachment plate 240, the force that the hydrofoil 180 (FIGS. 1A and 1B) is expected to sustain when in use, a desired amount of adjustability in the performance, and/or one or more other factors of the structural components in the attachment system 160 or relevant in its performance, transport, or storage. Merely by way of example, the inter-rail spacing $W_I$ may be at or below ⅔, or ½, or ⅓ of the width of the board 110 at its widest part; or at or below ¾ meters, ⅔ meters, ½ meters, ⅓ meters; or at least 1/20 meters, 1/10 meters, ⅕ meters. As another example, one or both of the rail widths $W_A$ and $W_B$ may each be at or below ½, ⅓, or ¼ of the width of the board 110 at its widest part; or at or below ½ meters, ⅓ meters, ¼ meters, ⅕ meters, 1/10 meters, 1/15 meters, 1/20 meters, 1/25 meters; or at least 1/30 meters, 1/40 meters, 1/30 meters. As a further example, one or both of the rail lengths may each be at or below ⅔, ½, ⅓, or ¼ of the length (between the nose portion 110C and the tail portion 110D) of the board 110; or at or below 2 meters, 1½ meters, 1 meter, ⅘ meters, ¾ meters, ⅔ meters, ½ meters; or at least ⅓ meters, ½ meters, ⅔ meters. As still a further example, one or both of the rail thicknesses may be at or below 2 inches, 1½ inches, 1 inch, ⅔ inches, ½ inches; or at least ⅛ inches, ⅙ inches, ⅕ inches.

As shown in FIGS. 2A-2C, the attachment plate 240 positions the locking mechanisms 225 (also referred to as locking components) apart from each other such that they are arranged in a manner to slidably receive the attachment rails 210. The attachment plate 240 may have attachment plate dimensions including an attachment plate width along the x axis, an attachment plate length along the y axis, and an attachment plate thickness along the z axis. The attachment plate width is defined by two longitudinal edges 245A and 245B (extending along the y axis) of the attachment plate 240 and spans across the attachment rails 210A and 210B. The attachment plate width may be selected such that the longitudinal edges 245A and 245B (substantially) align with the outer edges 215A and 215B of the attachment rails 210A and 210B, respectively. The attachment plate 240 can include the mast attachment base 250 that can receive and/or otherwise be connected to the mast 150 (FIG. 1A) of the hydrofoil 180 (FIG. 1A). In some embodiments, the mast attachment base 250 can be sized and shaped to receive or otherwise attach other components to a watersport board, such as a fin, a sail, or the like. The mast attachment base 250 may be mounted to or integrally formed with the attachment plate 240. In some embodiments, the mast attachment base 250 may be substantially flat. In some embodiments, the mast attachment base 250 may be omitted and the mast 150 may be coupled to the attachment plate 240 directly.

The locking mechanisms 225 (identified individually as a first locking mechanism 225A and a second locking mechanism 225B) may be configured to adjustably (e.g., slidably) couple the attachment plate 240 to the attachment rails 210 such that the attachment plate 240 may move and be locked at a position along the attachment rails 210. The locking component 225 may be coupled to longitudinal edges 245 (identified individually as a first longitudinal edge 245A and a second longitudinal edge 245B) of the attachment plate 240. The locking component 225 may have two states, a locked state and a released state. When at least one of the locking mechanisms 225 is in the locked state, the attachment plate 240 may be unmovable but locked at a position along the attachment rails 210. When both locking mechanisms 225 are at the released state, the attachment plate 240 may move along the attachment rails 210 (e.g., within a range defined by the stoppers 260). Additional descriptions regarding the interaction between the attachment plate 240, the attachment rails 210, and the locking mechanisms 225 may be found elsewhere in the present document. See, e.g., FIGS. 3A and 3B and the description thereof.

Merely by way of example, at least one of the locking mechanisms 225 may include a cam clamp. As illustrated in FIGS. 2A through 2C, the locking mechanism 225 may include a cam lever 220 (identified individually as 220A and 220B), a cam base 230 (identified individually as 230A and 230B), and a cam shaft 280 (identified individually as 280A and 280B). The cam base 230 may be mounted on the attachment plate 240 and have two base portions spaced by a distance. The cam shaft 280 may be supported by the two base portions of the cam base 230. For example, each of the two base portions has a hole so that two end portions of the cam shaft 280 may be placed in the holes, respectively. At least one of the two holes may be a through hole or a blind hole. For example, both holes are through holes, or both are blind holes, or one is a through hole and the other is a blind hole. The cam lever 220 may be rotatably coupled to the cam shaft 280 so that the cam lever 220 may change between a first position (as illustrated in FIGS. 2A-2C, 4C, and 4F) that corresponds to the locked state of the locking mechanism 225 and a second position (as illustrated in FIGS. 4D and 4E) that corresponds to the released state of the locking mechanism 225. The change between the first position and the second position may be achieved by rotating the cam lever 220 by a manual, toolless motion by a user.

When in use, a hydrofoil that is attached to the mast attachment base 250 may be moved relative to the length of the board (i.e., along the y-axis) by sliding the attachment plate 240 along the rails 210. Accordingly, the position of the hydrofoil may be manually adjusted (using only the user's hands) conveniently by placing both locking mechanisms 225 in the released state. Once the desired location along the length of the board is achieved, the locking mechanisms 225 can be placed in the locked state, again via manual toolless manipulation of the locking mechanisms 225.

Figure 3A:
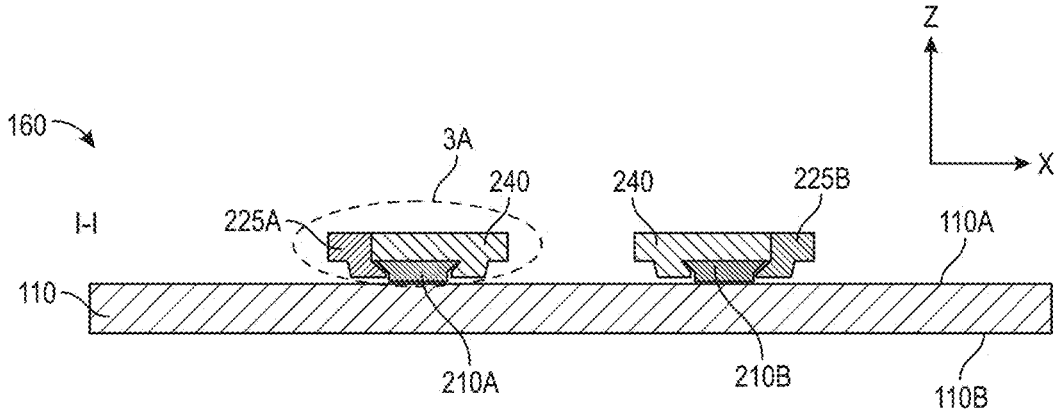
FIG. 3A is a cross-sectional view of the attachment assembly taken substantially along the line I-I of FIG. 2B.

FIG. 3A is a cross-sectional view of the attachment system 160 taken substantially along the line I-I of FIG. 2B. The attachment rails 210 are shown mounted on an external, bottom surface 110A of the board 110. This external mounting of the attachment rails 210 provides for convenient installation and obviates the need to create cavities in the board 110 to accommodate the attachment rails 210, thereby simplifying the structure and manufacture of the board 110, and reducing the thickness and weight of the board 110.

Figure 3B:
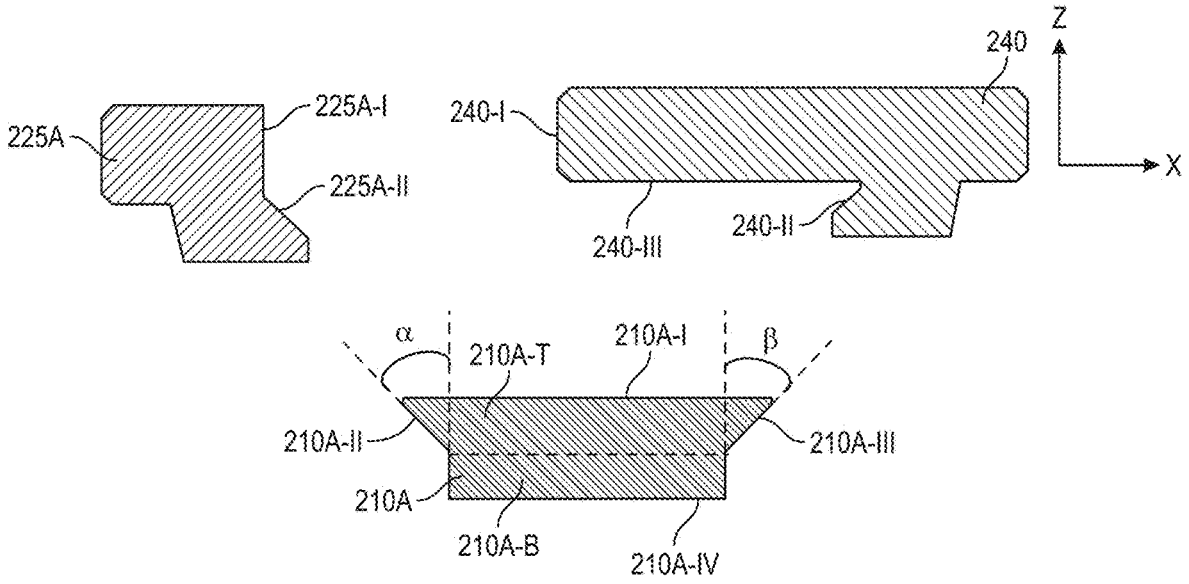
FIG. 3B is an exploded view of a portion of the attachment assembly of FIG. 3A.

FIG. 3B is an exploded view of a portion of the attachment system 160 in the oval 3A of FIG. 3A. In particular, FIG. 3B illustrates the first attachment rail 210A, the first locking mechanism 225A, and a portion of the attachment plate 240. It is understood that the second attachment rail 210B and the second locking mechanism 225B can have similar or the same characteristics. As show in FIG. 3B, the first attachment rail 210A can have a bottom portion 210A-B (also referred to as a first portion, a base portion, or the like) and a top portion 210A-T (also referred to as a second portion) extending from the base portion 210A-B. The base portion 210A-B may have a surface 210A-IV that is close to or in contact with the bottom surface 110A (FIG. 3A) of the board 110 (FIG. 3A). The top portion 210A-T may have a surface 210A-I that opposes or is in contact with a surface 240-III of the attachment plate 240, a first grip surface 210A-II that opposes or is in contact with a locking surface 225A-II of the locking mechanism 225A (e.g., on the cam lever 220A of the locking mechanism 225A), and a second grip surface 210A-III that opposes or is in contact with a surface 240-II of the attachment plate 240. In the illustrated embodiment, the top portion 210A-T has a greater cross-sectional area than the base portion 210A-B and a wedge-like shape that allows the locking mechanism 225A and the attachment plate 240 to extend over and at least partially around it to provide a track or rail along which the attachment assembly 265 (FIG. 2A) can slide and a gripping surface to which the attachment assembly 265 can be secured. For example, the first grip surface 210A-II of the top portion 210A-T may be at an angle α with the z-axis and is complementary to the angle of the locking surface 225A-II of the locking mechanism 225A. The angle α may be a value within a range between 30 degrees and 60 degrees. For example, the angle α may be 30 degrees, 35 degrees, 40 degrees, 45 degrees, 50 degrees, 55 degrees, or 60 degrees. The second grip surface 210A-III may be at an angle β with the z-axis and is complementary to the angle of the surface 240A-II of the attachment plate 240. The angle β may be a value within a range between 30 degrees and 60 degrees. For example, the angle β may be 30 degrees, 35 degrees, 40 degrees, 45 degrees, 50 degrees, 55 degrees, or 60 degrees. The angle α and the angle β may be the same or different. In some embodiments, the attachment rails 210 can have other suitable shapes that allow the locking mechanisms 225 to partially extend around and/or otherwise grip the rails 210.

A pair of surfaces that oppose or are in contact with each other may have complimentary surface features to keep the surfaces in place. For example, a surface 240-I of the attachment plate 240 and a surface 225A-I of the locking mechanism 225A (e.g., on the cam lever 220A of the locking mechanism 225A) may be configured to face each other and/or have complimentary surface features including, e.g., teeth, to keep the two surfaces in place and/or retain the relative position of the attachment plate 240 and the locking mechanism 225A when the locking mechanism 225A is in the locked state. As another example, at least one of the surface 210A-I and the surface 240-III may be configured to face each other and/or include a pad or coating (e.g., friction rubber) configured to increase friction for relative movement between the two surfaces and/or retain the relative position of the attachment plate 240 and the attachment rail 210, and also to offer a dampening/compression for the attachment rail 210A and attachment plate 240 to interface.

When the locking mechanism 225A is in the released state, the surface 225A-I may be spaced apart from the surface 240-I, and the locking surface 225A-II may be spaced apart from the first grip surface 210A-II, while the surface 240-III and the surface 210A-I may oppose (e.g., in contact) and be moveable (e.g., by sliding) relative to each other. In this way, by sliding along the attachment rails 210, the attachment plate 240 may move relative to the board 110, thereby adjusting the position of the hydrofoil 180 attached to the attachment plate 240. When the hydrofoil 180 is at a desired position, the locking mechanisms 225 may be changed to the locked state such that the surface 225A-I is in contact with the surface 240-I, and the surface 225A-II is in contact with the first grip surface 210A-II, while the surface 240-III and the surface 210A-I may be in contact, not moveable but locked on the attachment rail 210A. Accordingly, the position of the hydrofoil 180 may be adjusted conveniently by releasing the locking mechanisms 225 and locked by locking the locking mechanisms 225.

Figure 3C:
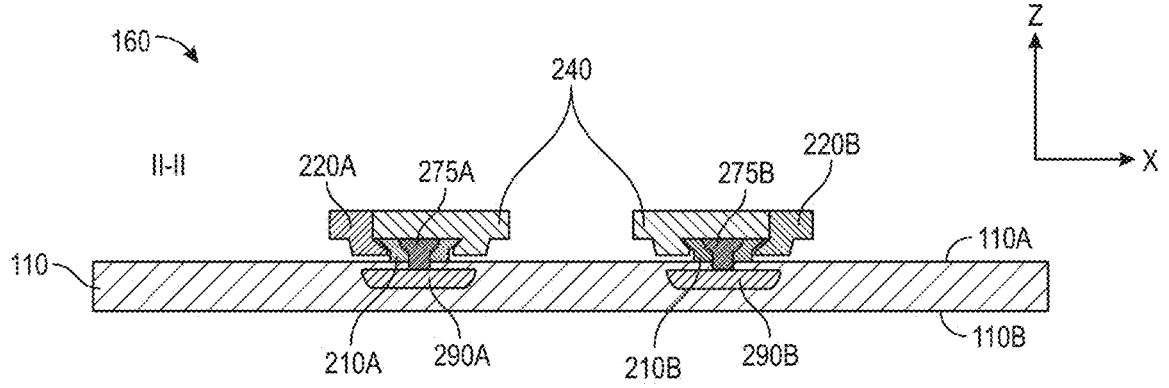
FIG. 3C is a cross-sectional view of the attachment assembly taken substantially along the line II-II of FIG. 2B.

FIG. 3C is a cross-sectional view of the attachment system 160 taken substantially along the line II-II of FIG. 2B. The attachment rails 210 may be mounted to the bottom surface 110A of the board 110 using the attachment rail mounting fasteners 275. As illustrated, the attachment rail mounting fasteners 275 may penetrate into the board 110. For example, the board 110 may include inserts 290 (identified individually as a first insert 290A and a second insert 290B) that receive the attachment rail mounting fasteners 275. The inserts 290 may be nuts, or other components configured to secure the attachment rail mounting fasteners 275 in place.

Various components of the attachment system 160 (e.g., the attachment rails 210, the attachment plate 240, the locking mechanisms 225 (e.g., the cam levers 220, the cam bases 230, the cam shafts 280) may be made of a material including, e.g., aluminum, plastic, or a composite. For example, the attachment rails 210 may be produced in injection plastic or carbon fiber compression.

Figure 4A:
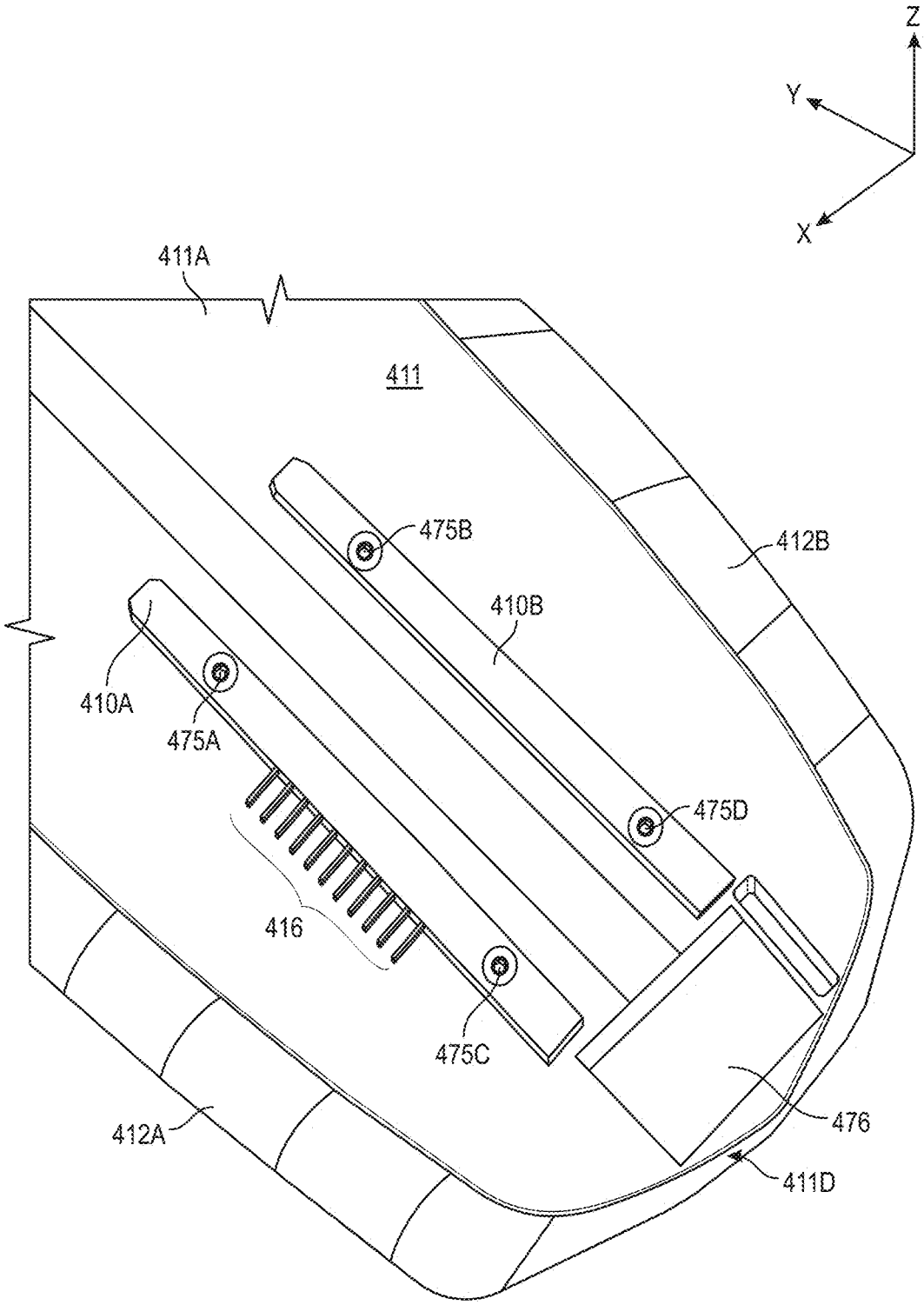
FIG. 4A is a perspective view of attachment rails on a watersport board configured in accordance with embodiments of the present technology.

FIG. 4A is a perspective view of attachment rails 410 (identified individually as a first attachment rail 410A and a second attachment rail 410B) of a watersport board 411 configured in accordance with embodiments of the present technology. As illustrated, the board 411 includes attachment rails 410 protruding from an external surface 411A of the board 411 and positioned close to a tail portion 411D of the board 411. The external surface 411A may be the bottom surface of the board 411. The bottom surface 411A may include an edge portion 412 (identified individually as a first edge portion 412A and a second edge portion 412B) substantially along the y-axis (or the length) of the board 411. The edge portion 412 may include design elements, for example a pattern with at least a portion being reflective. The bottom surface 411A may include a label 476 where information may be provided. For example, the label 476 may include information on how to use the board 411, safety warnings, and instructions on using the attachment assembly 265 to attach, remove, and/or adjust the hydrofoil on the board 411.

The attachment rails 410 are mounted on the bottom surface 411A using the attachment rail mounting fasteners 475 (identified individually as a first attachment rail mounting fastener 475A, a second attachment rail mounting fastener 475B, a third attachment rail mounting fastener 475C, a fourth attachment rail mounting fastener 475D). The bottom surface 411A may include position markings 416 to guide the positioning of the attachment assembly 265 and/or the hydrofoil along the y-axis or the length of the board 411.

Figure 4B:
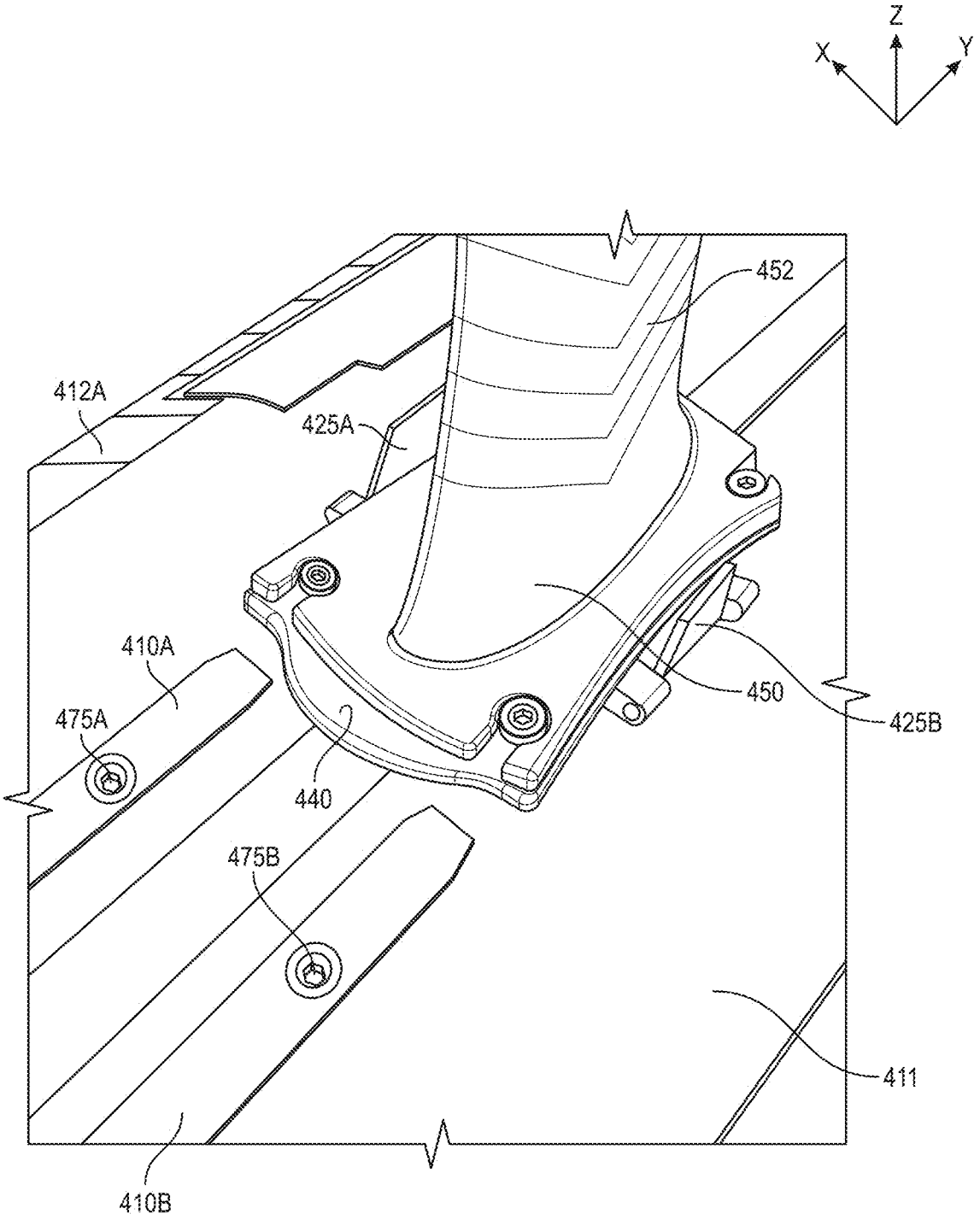
FIG. 4B is a perspective view of a base portion of a hydrofoil before engagement with the attachment rails of the watersport board of FIG. 4A.

FIG. 4B is a perspective view of a base portion of a hydrofoil before engagement with the attachment rails 410 of the watersport board 411 of FIG. 4A. As illustrated, the mast 450 is installed on the attachment plate 440 before being slid onto the attachment rails 410. In some embodiments, the attachment plate 440 may be slid onto the attachment rails 410 before the mast 450 is installed onto the attachment plate 440. The mast 450 may include design elements 452, for example a pattern with at least a portion being reflective.

Figure 4C:
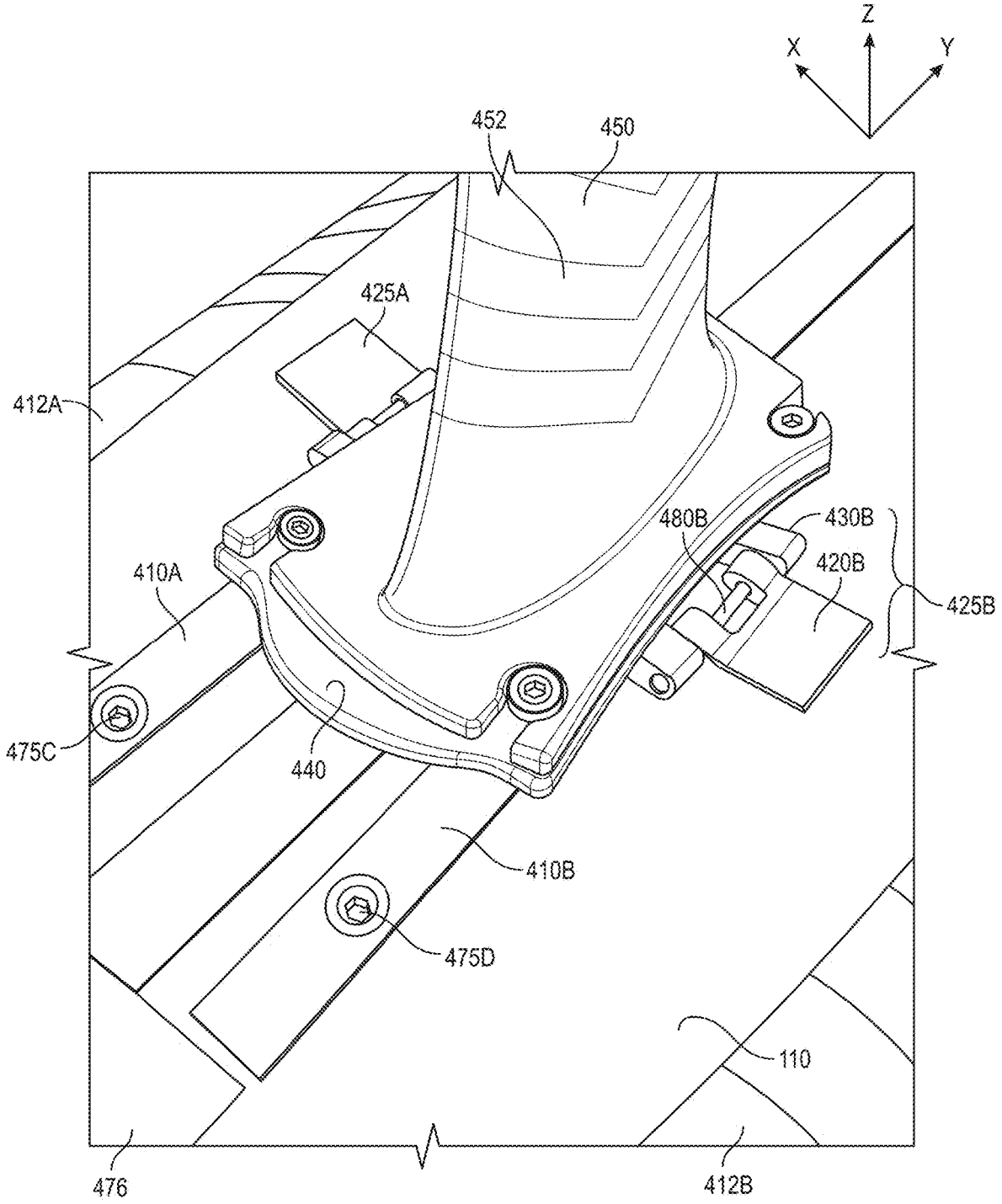
FIGS. 4C and 4D are perspective views of the base portion of the hydrofoil mounted in a first position along the attachment rails of the watersport board of FIGS. 4A and 4B in an engaged position and a disengaged position, respectively, in accordance with embodiments of the present technology.
Figure 4D:
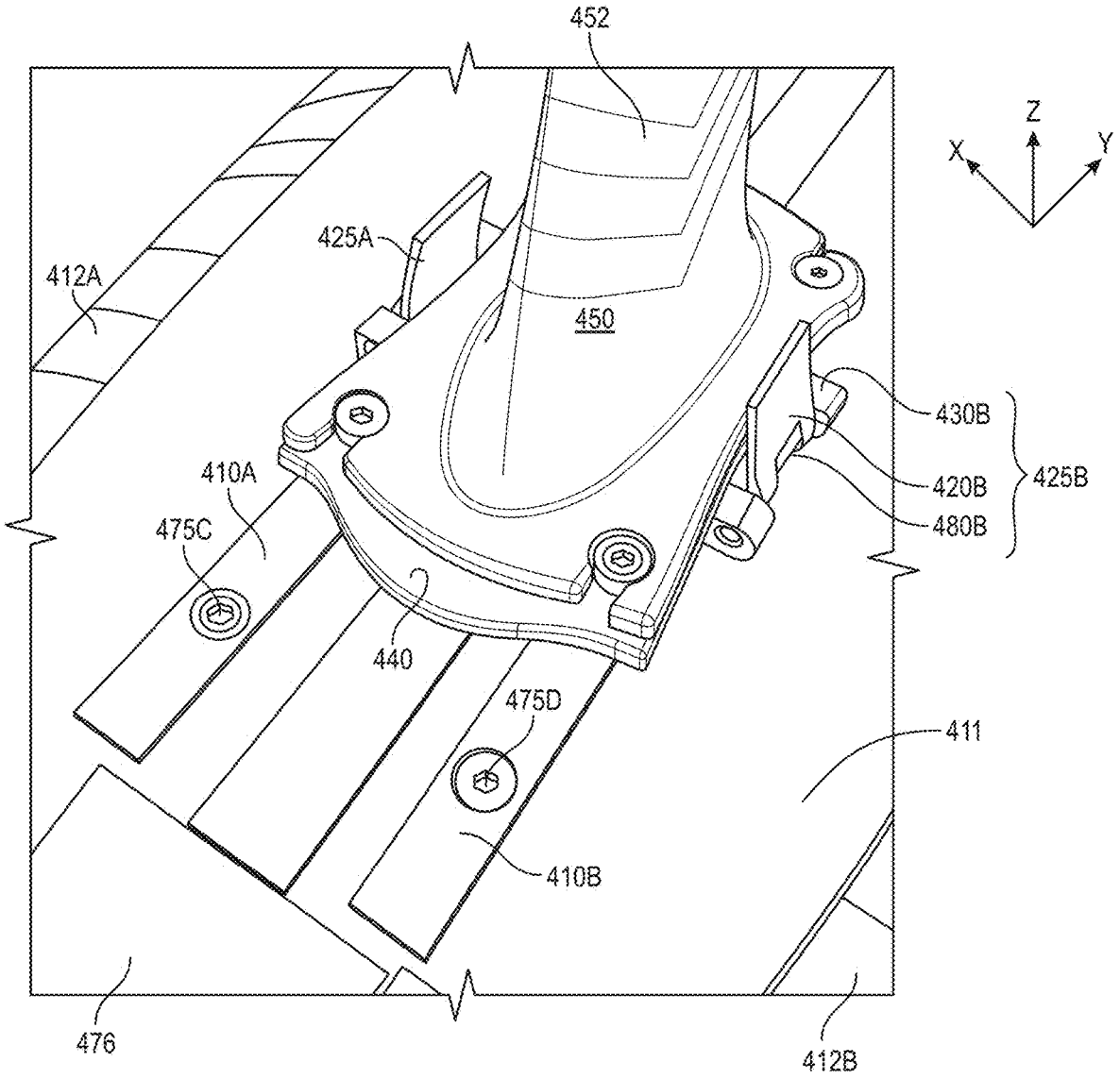
Figure 4E:
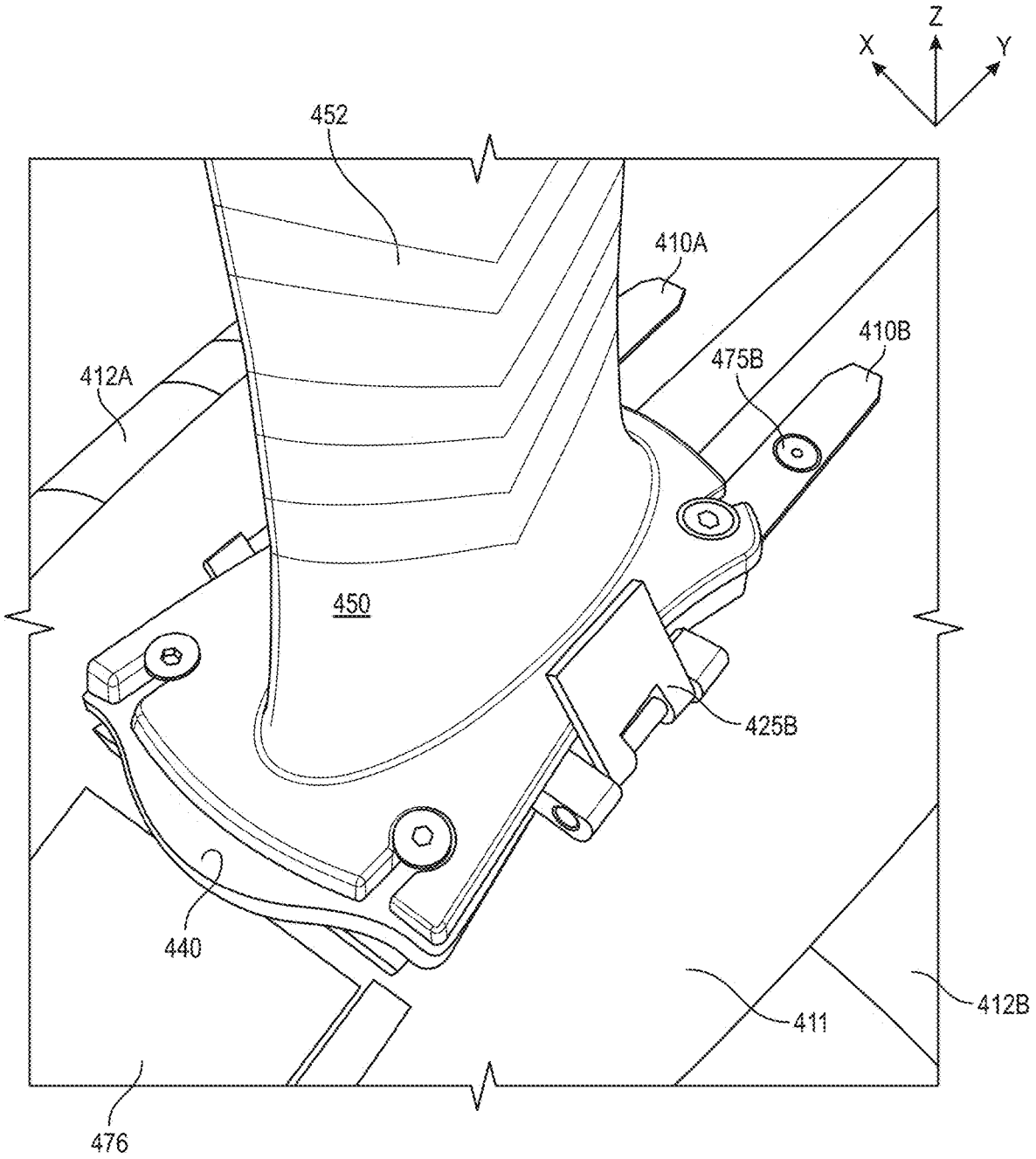
FIGS. 4E and 4F are perspective views of the base portion of the hydrofoil mounted in a second position along the attachment rails of the watersport board of FIGS. 4A and 4B in an engaged position and a disengaged position, respectively, in accordance with embodiments of the present technology.

FIGS. 4C and 4D are perspective views of the base portion of the hydrofoil mounted in a first position along the attachment rails 410 of the watersport board 411 of FIGS. 4A and 4B in an engaged position and a disengaged position, respectively, in accordance with embodiments of the present technology. The locking component 425 (identified individually as a first locking component 425A and a second locking component 425B) may be a cam clamp including a cam lever 420 (identified individually as a first cam lever 420A and a second cam lever 420B) coupled to a cam shaft 480 (identified individually as a first cam shaft 480A and a second cam shaft 480B), and a cam base 430 (identified individually as a first cam base 430A and a second cam base 430B) to which the cam shaft 480 is connected. As illustrated in FIG. 4C, the locking components 425 are at the locked state and therefore the attachment plate 440 and the mast 450 are locked at a first position (e.g., a forward position). As illustrated in FIG. 4D, the locking components 425 are at the released state and therefore the attachment plate 440 and the mast 450 can move away from the first position, e.g., to a second position as illustrate in FIGS. 4E and 4F.

Figure 4F:
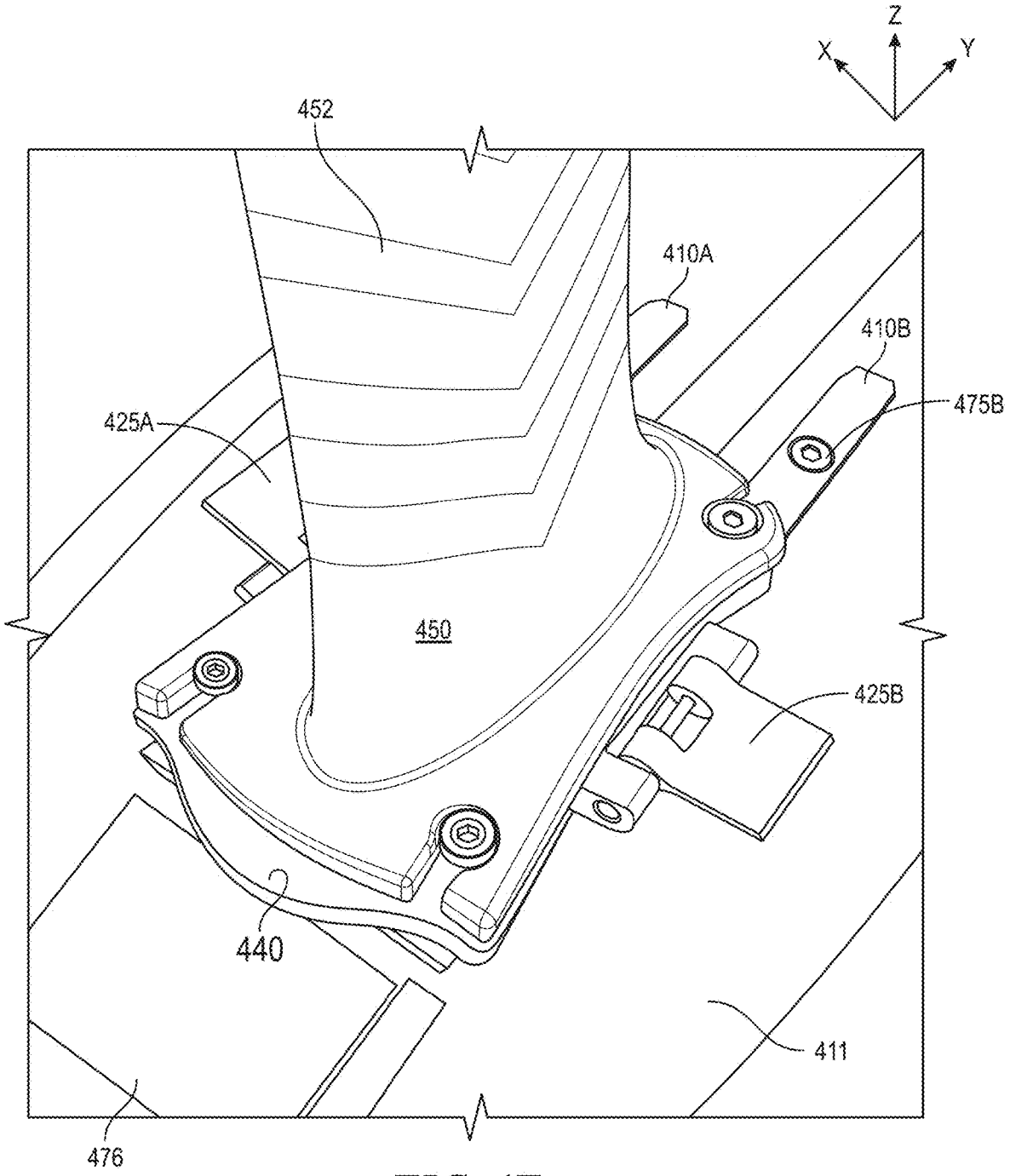

FIGS. 4E and 4F are perspective views of the base portion of the hydrofoil mounted in a second position along the attachment rails 410 of the watersport board 411 of FIGS. 4A and 4B in an engaged position and a disengaged position, respectively, in accordance with embodiments of the present technology. As illustrated in FIG. 4E, the locking components 425 are at the released state, and the attachment plate 440 and the mast 450 of the hydrofoil are in the second position (e.g., a backward position). As illustrated in FIG. 4F, the locking components 425 are at the locked state and therefore the attachment plate 440 and the mast 450 are locked in the second position.

Figure 5:
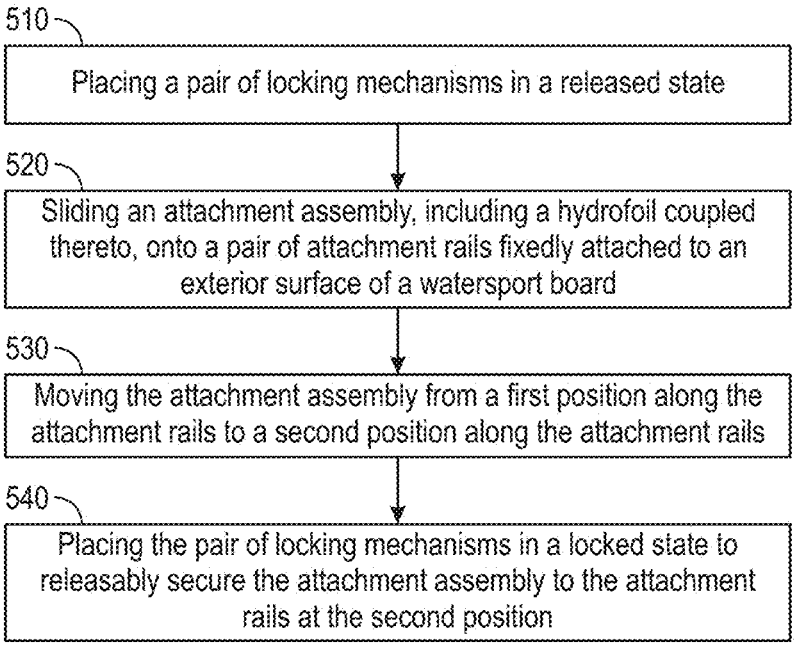
FIG. 5 is a flowchart illustrating a method of using a board with an attachment assembly configured in accordance with embodiments of the present technology.

FIG. 5 is a flowchart illustrating a process of using a watersport board with an attachment system configured in accordance with embodiments of the present technology. The process may include placing a pair of locking mechanisms to a released state at 510. The process may include sliding an attachment plate, including a hydrofoil coupled thereto, onto a pair of attachment rails that are fixedly attached to an exterior surface of the watersport board at 520. In some embodiments, the pair of locking mechanisms are configured to slidably couple the attachment plate to the pair of the attachment rails. The process may include moving the attachment plate from a first position along the attachment rails to a second position along the attachment rails at 530. The process may include placing the pair of locking mechanisms to a locked state so that the attachment plate and the hydrofoil are locked at the second position along the attachment rails at 540. To achieve an adjustment of the position of the hydrofoil, the process may further include changing the pair of locking mechanisms from the locked state to the released state; moving the attachment plate from the second position to a third position; and placing the pair of locking mechanisms to the locked state so that the attachment plate and the hydrofoil are locked at the third position. The locking mechanisms may be switched between the locked state and the released state by a toolless maneuver by a user. Merely by way of example, the pair of locking mechanisms may include a pair of cam clamps. Each of the pair of cam clamps may include a cam base, a cam shaft supported on the cam base, and a cam lever rotatably coupled to the cam shaft. Accordingly, the user may change the pair of locking mechanisms from the locked state to the released state by rotating the cam lever around the cam shaft from a first cam position corresponding to the locked state to a second cam position corresponding to the release state of the locking mechanisms. The user does not need a tool to adjust the position of the hydrofoil. Accordingly, the user can adjust the position of the hydrofoil along the length of the watersport board toollessly and conveniently while riding the watersport board (regardless of whether the hydrofoil (or a portion thereof) is out of the water or submerged in the water) as desired, depending on one or more factors including, e.g., the user's experience level, the user's preference or expectation for a particular ride, the weather conditions, and/or the conditions of the water.

Examples

The following examples are illustrative of several embodiments of the present technology.

1. A hydrofoil attachment system, comprising:

a plurality of attachment rails configured to be fixedly attached to an external surface of a watersport board such that the attachment rails project outwardly away from the external surface, an attachment assembly configured to releasably couple to the plurality of attachment rails, the attachment assembly comprising— an attachment plate having a first side and a second side opposite the first side, wherein the attachment plate is configured to couple to a mast of a hydrofoil; and a plurality of locking components on the attachment plate and configured to slidably couple the attachment plate to the attachment rails, wherein the locking components are configured to be manually manipulated to move between a locked configuration and a released configuration, and wherein— when the locking components are in a released state, the attachment plate is allowed to slide along the attachment rails, and when at least one of the locking components is in the locked state, the attachment plate is fixedly secured to the attachment rails.

2. The hydrofoil attachment system of any one or more of the embodiments disclosed herein wherein at least one of the attachment rails is substantially wedge-shaped.

3. The hydrofoil attachment system of any one or more of the embodiments disclosed herein wherein each of the plurality of attachment rails has a first surface configured to face a second surface of one of the locking components, and wherein the first surface contacts the second surface when the locking component is in the locked state.

4. The hydrofoil attachment system of any one or more of the embodiments disclosed herein wherein the first surface is at an angle with an axis perpendicular to the watersport board, the angle being between 30 degrees and 60 degrees.

5. The hydrofoil attachment system of any one or more of the embodiments disclosed herein wherein:

the first surface is a first grip surface;

each of the plurality of attachment rails has a second grip surface configured to face a surface of the attachment plate; and the second grip surface contacts the surface of the attachment plate when at least one of the locking components is in the locked state.

6. The hydrofoil attachment system of any one or more of the embodiments disclosed herein wherein the second grip surface is at an angle with an axis perpendicular to the watersport board, the angle being between 30 degrees and 60 degrees.

7. The hydrofoil attachment system of any one or more of the embodiments disclosed herein wherein a surface of the attachment plate opposes a surface of one of locking components when the locking component is in the locked state.

8. The hydrofoil attachment system of any one or more of the embodiments disclosed herein wherein the surface of the attachment plate and the opposing surface of the locking component comprise complimentary surface features to retain the relative position of the attachment plate and the locking component when the locking component is in the locked state.

9. The hydrofoil attachment system of any one or more of the embodiments disclosed herein wherein the complimentary surface features comprise teeth or a pad or coating that is configured to increase friction for relative movement between the two surfaces.

10. The hydrofoil attachment system of any one or more of the embodiments disclosed herein wherein a surface of one of the attachment rails opposes a surface of the attachment plate when at least one of the locking components is in the locked state.

11. The hydrofoil attachment system of any one or more of the embodiments disclosed herein wherein the surface of the attachment plate and the opposing surface of the attachment rail comprise complimentary surface features to retain the relative position of the attachment plate and the attachment rail when the at least one of the locking components is in the locked state.

12. The hydrofoil attachment system of any one or more of the embodiments disclosed herein wherein the complimentary surface features comprise teeth or a pad or coating that is configured to increase friction for relative movement between the two surfaces.

13. The hydrofoil attachment system of any one of the embodiments disclosed herein wherein at least one of the locking components comprises a cam clamp.

14. The hydrofoil attachment system of any one or more of the embodiments disclosed herein wherein the cam clamp comprises a lever that is rotatable between a first position that corresponds to the locked state of the locking component and a second position that corresponds to the released state of the locking component.

15. The hydrofoil attachment system of claim 14 wherein the cam clamp comprises a cam base and a cam shaft attached to the cam base, the lever being rotatably supported on the cam shaft.

16. The hydrofoil attachment system of any one or more of the embodiments disclosed herein further comprising a first stopper and a second stopper spaced apart from each other by a distance along each of one or both of the attachment rails, wherein the distance between the first and second stoppers defines a movement range within which the attachment plate is allowed to slide along the pair of the attachment rails.

17. A watersport system, comprising a watersport board, a hydrofoil, and an attachment system, wherein the attachment system comprises:

a plurality of attachment rails configured to be fixedly attached to an external surface of the watersport board such that the attachment rails project outwardly away from the external surface, an attachment assembly configured to releasably couple to the plurality of attachment rails, the attachment assembly comprising— an attachment plate having a first side and a second side opposite the first side, wherein the attachment plate is configured to couple to a mast of the hydrofoil; and a plurality of locking components on the attachment plate and configured to slidably couple the attachment plate to the attachment rails, wherein the locking components are configured to be manually manipulated to move between a locked configuration and a released configuration, and wherein— when the locking components are in a released state, the attachment plate is allowed to slide along the attachment rails, and when at least one of the locking components is in the locked state, the attachment plate is fixedly secured to the attachment rails.

18. A method of attaching a hydrofoil to a watersport board, the method comprising:

positioning a pair of locking components to a released state, wherein the locking components are coupled to an attachment plate having a mast of the hydrofoil extending therefrom;

sliding the pair of locking components onto a corresponding pair of attachment rails fixedly mounted to an external surface of the watersport board;

moving the attachment plate to a desired position along a length of the pair of attachment rails; and positioning, via a manual, toolless motion, the pair of locking components in a locked state to secure the attachment plate to the watersport board at the desired position.

19. The method of any one or more of the embodiments disclosed herein further comprising:

changing, via a second manual, toolless motion, the pair of locking components from the locked state to the released state;

moving the attachment plate from the desired position to a second position; and positioning, via a third manual, toolless motion, the pair of locking components to the locked state to secure the attachment plate to the watersport board at the second position.

20. The method of any one or more of the embodiments disclosed herein wherein:

the pair of locking components comprise a pair of cam clamps, each of the pair of cam clamps comprises a cam base, a cam shaft supported on the cam base, and a cam lever rotatably coupled to the cam shaft, and the changing the pair of locking components from the locked state to the released state comprises for each of the pair of locking components, rotating the cam lever around the cam shaft from a first cam position corresponding to the locked state to a second cam position corresponding to the released state of the locking component.

21. A system for removably and adjustably attaching a hydrofoil to a watersport board as shown and described herein.

22. A method of using a hydrofoil on a watersport board as shown and described herein.

23. A system as substantially shown and described herein.

24. A method as substantially shown and described herein.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present technology have been shown and described, it will be obvious to those skilled in the art that, based upon the teachings herein, changes and modifications may be made without departing from this technology and its broader aspects and, therefore, the appended claims are to encompass within their scope all such changes and modifications as are within the true spirit and scope of this technology. Furthermore, it is to be understood that the technology is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to technologies containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For example, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

What is claimed is:

1. A hydrofoil attachment system, comprising:

a plurality of attachment rails configured to be fixedly attached to an external surface of a watersport board such that the attachment rails project outwardly away from the external surface, an attachment assembly configured to releasably couple to the plurality of attachment rails, the attachment assembly comprising— an attachment plate having a first side and a second side opposite the first side, wherein the attachment plate is configured to couple to a mast of a hydrofoil; and a plurality of locking components on the attachment plate and configured to slidably couple the attachment plate to the attachment rails, wherein the locking components are configured to be manually manipulated to move between a locked configuration and a released configuration, and wherein— when the locking components are in a released state, the attachment plate is allowed to slide along the attachment rails, and when at least one of the locking components is in the locked state, the attachment plate is fixedly secured to the attachment rails.

2. The hydrofoil attachment system of claim 1 wherein at least one of the attachment rails is substantially wedge-shaped.

3. The hydrofoil attachment system of claim 2 wherein each of the plurality of attachment rails has a grip surface configured to face a locking surface of one of the locking components, and wherein the grip surface contacts the locking surface when the locking component is in the locked state.

4. The hydrofoil attachment system of claim 3 wherein the grip surface is at an angle with an axis perpendicular to the watersport board, the angle being between 30 degrees and 60 degrees.

5. The hydrofoil attachment system of claim 3 wherein:

the grip surface is a first grip surface;

each of the plurality of attachment rails has a second grip surface configured to face a surface of the attachment plate; and the second grip surface contacts the surface of the attachment plate when at least one of the locking components is in the locked state.

6. The hydrofoil attachment system of claim 5 wherein the second grip surface is at an angle with an axis perpendicular to the watersport board, the angle being between 30 degrees and 60 degrees.

7. The hydrofoil attachment system of claim 1 wherein a surface of the attachment plate opposes a surface of one of locking components when the locking component is in the locked state.

8. The hydrofoil attachment system of claim 7 wherein the surface of the attachment plate and the opposing surface of the locking component comprise complimentary surface features to retain the relative position of the attachment plate and the locking component when the locking component is in the locked state.

9. The hydrofoil attachment system of claim 8 wherein the complimentary surface features comprise teeth or a pad or coating that is configured to increase friction for relative movement between the two surfaces.

10. The hydrofoil attachment system of claim 1 wherein a surface of one of the attachment rails opposes a surface of the attachment plate when at least one of the locking components is in the locked state.

11. The hydrofoil attachment system of claim 10 wherein the surface of the attachment plate and the opposing surface of the attachment rail comprise complimentary surface features to retain the relative position of the attachment plate and the attachment rail when the at least one of the locking components is in the locked state.

12. The hydrofoil attachment system of claim 11 wherein the complimentary surface features comprise teeth or a pad or coating that is configured to increase friction for relative movement between the two surfaces.

13. The hydrofoil attachment system of claim 1 wherein at least one of the locking components comprises a cam clamp.

14. The hydrofoil attachment system of claim 13 wherein the cam clamp comprises a lever that is rotatable between a first position that corresponds to the locked state of the locking component and a second position that corresponds to the released state of the locking component.

15. The hydrofoil attachment system of claim 14 wherein the cam clamp comprises a cam base and a cam shaft attached to the cam base, the lever being rotatably supported on the cam shaft.

16. The hydrofoil attachment system of claim 1, further comprising a first stopper and a second stopper spaced apart from each other by a distance along one of the attachment rails, wherein the distance between the first and second stoppers defines a movement range within which the attachment plate is allowed to slide along the attachment rail.

17. A watersport system, comprising a watersport board, a hydrofoil, and an attachment system, wherein the attachment system comprises:

a plurality of attachment rails configured to be fixedly attached to an external surface of the watersport board such that the attachment rails project outwardly away from the external surface, an attachment assembly configured to releasably couple to the plurality of attachment rails, the attachment assembly comprising— an attachment plate having a first side and a second side opposite the first side, wherein the attachment plate is configured to couple to a mast of the hydrofoil; and a plurality of locking components on the attachment plate and configured to slidably couple the attachment plate to the attachment rails, wherein the locking components are configured to be manually manipulated to move between a locked configuration and a released configuration, and wherein— when the locking components are in a released state, the attachment plate is allowed to slide along the attachment rails, and when at least one of the locking components is in the locked state, the attachment plate is fixedly secured to the attachment rails.

18. A method of attaching a hydrofoil to a watersport board, the method comprising:

positioning a pair of locking components to a released state, wherein the locking components are coupled to an attachment plate having a mast of the hydrofoil extending therefrom;

sliding the pair of locking components onto a corresponding pair of attachment rails fixedly mounted to an external surface of the watersport board;

moving the attachment plate to a desired position along a length of the pair of attachment rails; and positioning, via a manual, toolless motion, the pair of locking components in a locked state to secure the attachment plate to the watersport board at the desired position.

19. The method of claim 18 further comprising:

changing, via a second manual, toolless motion, the pair of locking components from the locked state to the released state;

moving the attachment plate from the desired position to a second position; and positioning, via a third manual, toolless motion, the pair of locking components to the locked state to secure the attachment plate to the watersport board at the second position.

20. The method of claim 19 wherein:

the pair of locking components comprise a pair of cam clamps, each of the pair of cam clamps comprises a cam base, a cam shaft supported on the cam base, and a cam lever rotatably coupled to the cam shaft, and the changing the pair of locking components from the locked state to the released state comprises for each of the pair of locking components, rotating the cam lever around the cam shaft from a first cam position corresponding to the locked state to a second cam position corresponding to the released state of the locking component.

* * * * *